US005453725A

United States Patent [19]

You et al.

[11] Patent Number: 5,453,725

[45] Date of Patent: Sep. 26, 1995

[54] OVERCURRENT BREAKER SWITCH

[76] Inventors: Long-Cheng You, 3Fl., No. 6, Alley 36, Lane 252 Yuantung Rd., Chungho City, Taipei Hsien; Shou-Chi Kuo, No. 18, Lane 5, Hsling N. Rd., Taipei, both of Taiwan, Prov. of China

[21] Appl. No.: 249,132

[22] Filed: May 25, 1994

[51] Int. Cl.[6] ..... H01H 71/16; H01H 61/00; H01H 27/04

[52] U.S. Cl. ..... 337/68; 337/59; 337/52; 337/91; 200/61.19

[58] Field of Search ..... 337/36, 37, 52, 337/53, 56, 59, 60, 68, 91, 2, 43; 200/61.19; 218/89, 117

[56] References Cited

U.S. PATENT DOCUMENTS

| | | | |
|---|---|---|---|
| 4,068,203 | 1/1978 | Unger | 337/56 |
| 4,363,016 | 12/1982 | Unger | 337/56 |
| 4,528,538 | 7/1985 | Andersen | 337/43 |
| 4,833,439 | 5/1989 | Bowden | 337/68 |
| 5,021,761 | 6/1991 | Stack | 337/68 |
| 5,248,954 | 9/1993 | Chiang | 337/66 |

*Primary Examiner*—Leo P. Picard
*Assistant Examiner*—Stephen T. Ryan
*Attorney, Agent, or Firm*—Jones, Day, Reavis & Pogue

[57] ABSTRACT

An overcurrent breaker switch includes an upper housing including a lever block with a push rod and a lower housing engaged with the upper housing. First and second blades are mounted to the lower housing, the second blade having a dual metal plate mounted thereon. A lever plate base is mounted in the lower housing and has a first end for releasable electrical connection with the dual metal plate and a second end. A conductive lever plate is pivotally mounted to the second end of the lever plate base and actuatable by the push rod under operation of the lever block. The conductive lever plate has a first end for releasable electrical connection with the first blade and a second end on which a pressing piece is formed. An insulating plate is mounted between the lever plate base and the dual metal plate and has an insulating piece below the pressing piece of the conductive lever plate. A spring is mounted under the insulating piece to provide an upward force. When switch is under an overload condition, the dual metal plate disengages with the lever plate base and the insulating plate is moved upwardly under action of the spring thereby breaking the circuit.

6 Claims, 4 Drawing Sheets

OVERCURRENT BREAKER SWITCH

BACKGROUND OF THE INVENTION

1. Field of the Invention

The present invention relates to a switch which breaks the circuit when overcurrent passes.

2. Description of Related Art

Electricity is the most important power source to human from light and heavy industries to house living. In order to prevent possible damage caused by overcurrent, a breaker is generally provided between the power supply and the electric device to be protected. When the load current of the electric device exceeds a safety extent, the breaker turns off the power supply to avoid damage. Nevertheless, the user, after breakage of electricity, has to troublesomely switch off the power supply, examine and eliminate the overload causes, reset the overcurrent breaker, and switch on the power supply. This is because the overcurrent breaker is separate from the power supply and the electric device.

The present invention is intended to provide a safety switch with a overcurrent breaker to solve the aforementioned drawback.

SUMMARY OF THE INVENTION

An overcurrent breaker switch includes an upper housing including a lever block with a push rod and a lower housing engaged with the upper housing. First and second blades are mounted to the lower housing, the second blade having a dual metal plate mounted thereon. A lever plate base is mounted in the lower housing and has a first end for releasable electrical connection with the dual metal plate and a second end. A conductive lever plate is pivotally mounted to the second end of the lever plate base and actuatable by the push rod under operation of the lever block. The conductive lever plate has a first end for releasable electrical connection with the first blade and a second end on which a pressing piece is formed. An insulating plate is mounted between the lever plate base and the dual metal plate and has an insulating piece below the pressing piece of the conductive lever plate. A spring is mounted under the insulating piece to provide an upward force.

By such an arrangement, when switch is under an overload condition, the dual metal plate disengages with the lever plate base and the insulating lever plate is moved upwardly under action of the spring thereby breaking the circuit.

Other objects, advantages, and novel features of the invention will become more apparent from the following detailed description when taken in conjunction with the accompanying drawings.

DESCRIPTION OF THE PREFERRED EMBODIMENTS

Figure 1:
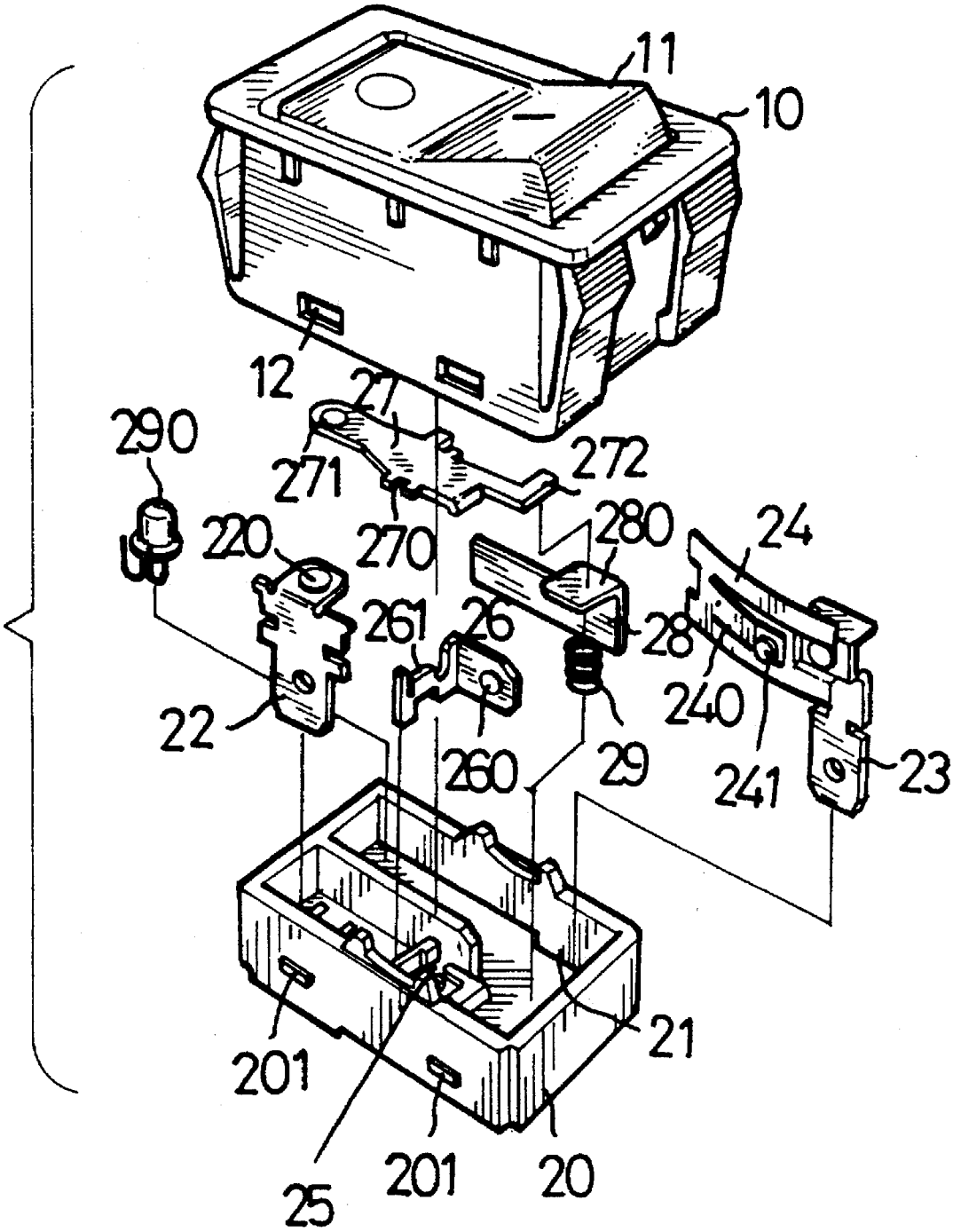
FIG. 1 is an exploded perspective view of an overcurrent breaker switch in accordance with the present invention.

Referring to the drawings and initially to FIG. 1, an overcurrent breaker switch in accordance with the present invention includes an upper housing 10 having a lever block 11 and two engaging slots 12 in each of two side walls thereof and a lower casing 20 having two protrusions 201 on each of two side walls thereof for releasably engaging with the engaging slots 12 in the upper housing 10.

Figure 2:
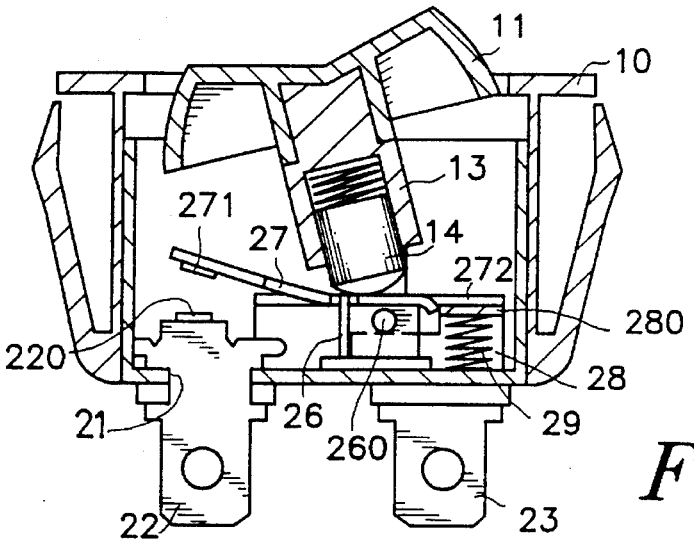
FIG. 2 is a vertical cross-sectional view of the overcurrent breaker switch in an OFF position.
Figure 5:
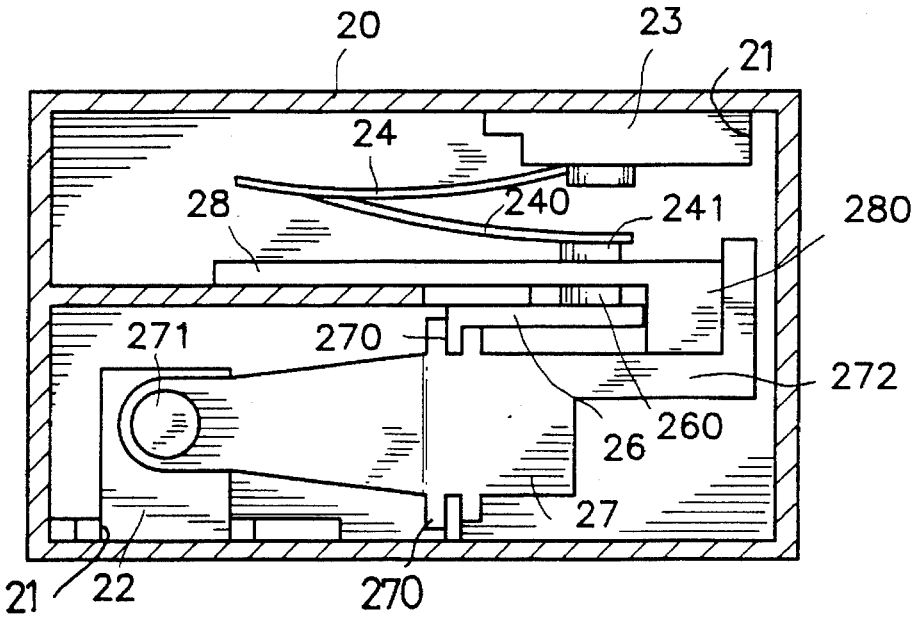
FIG. 5 is a view similar to FIG. 4, in which the switch is in an OFF position.

Referring to FIGS. 1, 2, and 5, two slots 21 are diagonally defined in two corners of a bottom wall of the lower casing 20 for respectively mounting blades 22 and 23 which, in turn, are electrically connected with conducting wires (not shown). Blade 22 is substantially L-shaped in section and has a platinum contact 220 on an upper end thereof, as clearly shown in FIG. 1. Blade 23 includes a dual metal plate 24 in an upper end thereof, said dual metal plate 24 is cut in a mediate section thereof to form a flexible plate 240 which, in turn, has a platinum contact 241 on a distal end thereof.

Figure 4:
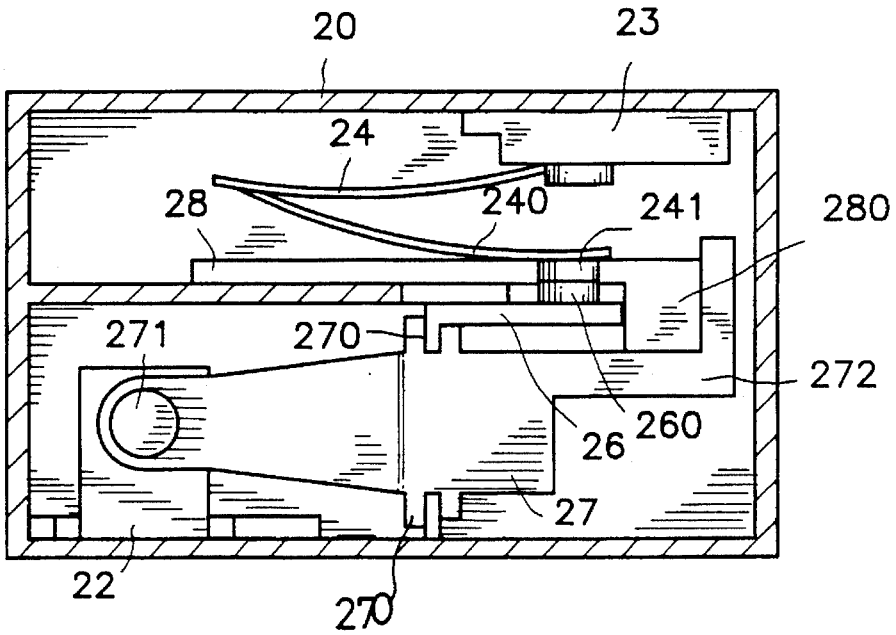
FIG. 4 is a horizontal cross-sectional view of the overcurrent breaker switch in an ON position.

The bottom wall of the lower casing 20 has therein a positioning groove 25 which is adjacent to one of the slots 21 for mounting a substantially L-shaped lever plate base 26, which, in turn, has a platinum contact 260 on one limb thereof for normal contact with the platinum contact 241 of the dual metal plate 24. The lever plate base 26 further has a recess 261 in another limb thereof in which a conductive lever plate 27 is mounted. As shown in FIGS. 1, 4, and 5, the conductive lever plate 27 includes a pair of engaging pieces 270 in a mediate section thereof for engaging with the recess 261 thereby allowing pivotal movement of the conductive lever plate 27. The conductive lever plate 27 further includes a platinum contact 271 on an underside of a first end thereof for cooperating with the platinum contact 220 on the blade 22. A pressing piece 272 is formed in a second end of the conductive lever plate 27.

An insulating plate 28 has an insulating piece 280 mounted below the pressing piece 272 and a spring 29 is mounted under the insulating piece 280 to bias the insulating piece 280 upwardly. Furthermore, the insulating plate 28 is mounted between the dual metal plate 24 and the lever plate base 26, and since platinum contacts 241 and 260 are normally engaged with each other, the insulating plate 28 is in a position under contacts 241 and 260 (see FIGS. 3 and 4). When the surface temperature of the dual metal plate 24 exceeds a pre-determined temperature (such as due to overload), it will disengage with the lever plate base 26, such that the insulating plate 28 is moved upwardly under the spring force of spring 29 to a position between the dual metal plate 24 and the lever plate base 26 to electrically disconnect the dual metal plate 24 and the lever plate base 26.

Furthermore, a light emitting diode (LED) 290 is provided between the lever plate base 26 and blade 22 to provide an indication after the switch is turned off.

Referring to FIG. 2, the lever block 11 of the upper housing 10 includes a cylinder 13 projecting from a bottom side thereof and in which a spring biased push rod 14 is partially received. The push rod 14 extends beyond the cylinder 13 and is selectively moved to depress either of first and second ends of the lever plate 27 under operation of the lever block 11. For example, as shown in FIG. 2, the lever block 11 is pressed at its left end which causes the push rod 14 to depress on the second end of the lever plate 27 such that contact 271 disengages with contact 220 on blade 22, i.e., the switch is OFF. Conversely, when the lever block 11 is pressed at its right end, as shown in FIG. 3, the push rod 14 is urged to depress on the first end of the lever plate 27 thereby contacting contact 271 with contact 220, i.e., the switch is ON.

Figure 3:
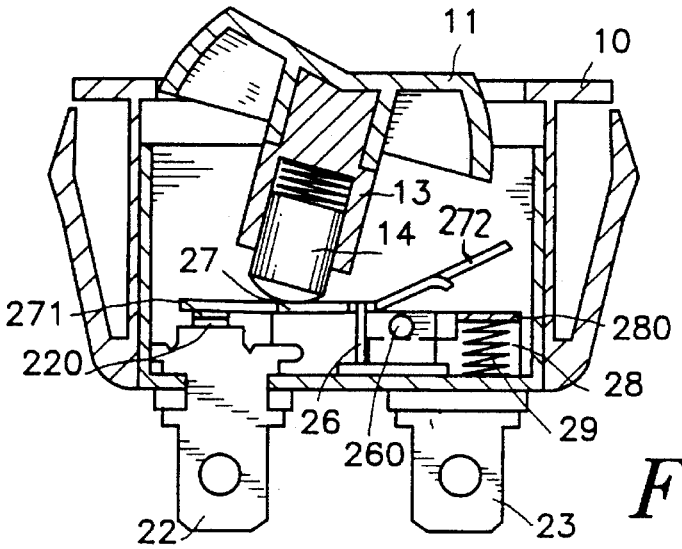
FIG. 3 is a view similar to FIG. 1, in which the switch is in an ON position.

In operation, the lever block 11 is pressed at its right end to cause electrical contact between contacts 271 and 220, as shown in FIG. 3, blade 22 is electrically connected with blade 23 via lever plate 27, lever plate base 26, and the dual metal plate 24 and thus forms a circuit as long as the current passing through the dual metal plate 24 remains under a pre-determined value. When the load of the electric device controlled by the switch is abnormally high such that the current passing through the dual metal plate 24 dramatically increases, the surface temperature of the dual metal plate 24 is increased and when it exceeds a predetermined temperature value, the dual metal plate 24 shall be twisted which causes disconnection between the contacts 241 and 260. The insulating plate 28 is moved upwardly by spring 29 and thus electrically separates the dual metal plate 24 and the lever plate base 26, thereby disconnecting blades 22 and 23, as shown in FIGS. 5 and 6.

Figure 6:
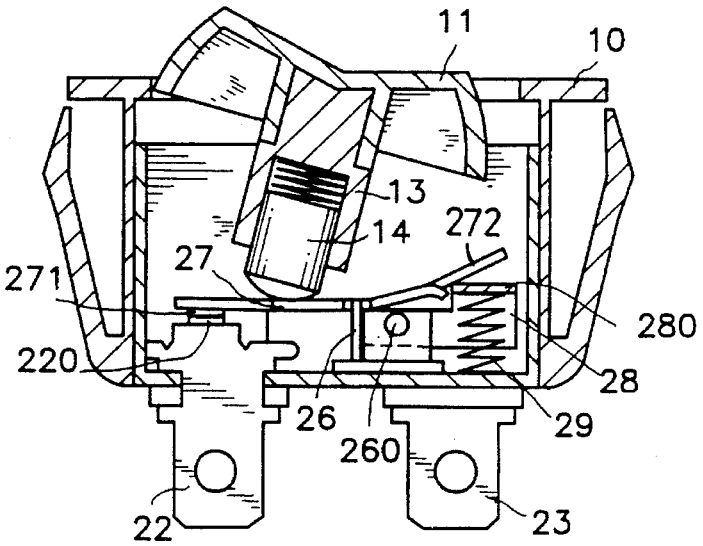
FIG. 6 is a view similar to FIG. 3, in which the switch is in an OFF position due to overload.

After the causes of abnormal load are excluded, the user may press the lever block 11 in FIG. 6 to a position shown in FIG. 2 (to cause the reengagement between the dual metal plate 24 and the lever plate base 26), and then to a position shown in FIG. 3 thereby forming a circuit again. It is appreciated that the user only has to simply press twice to reset the switch without troublesome operation required in the prior art.

Figure 7:
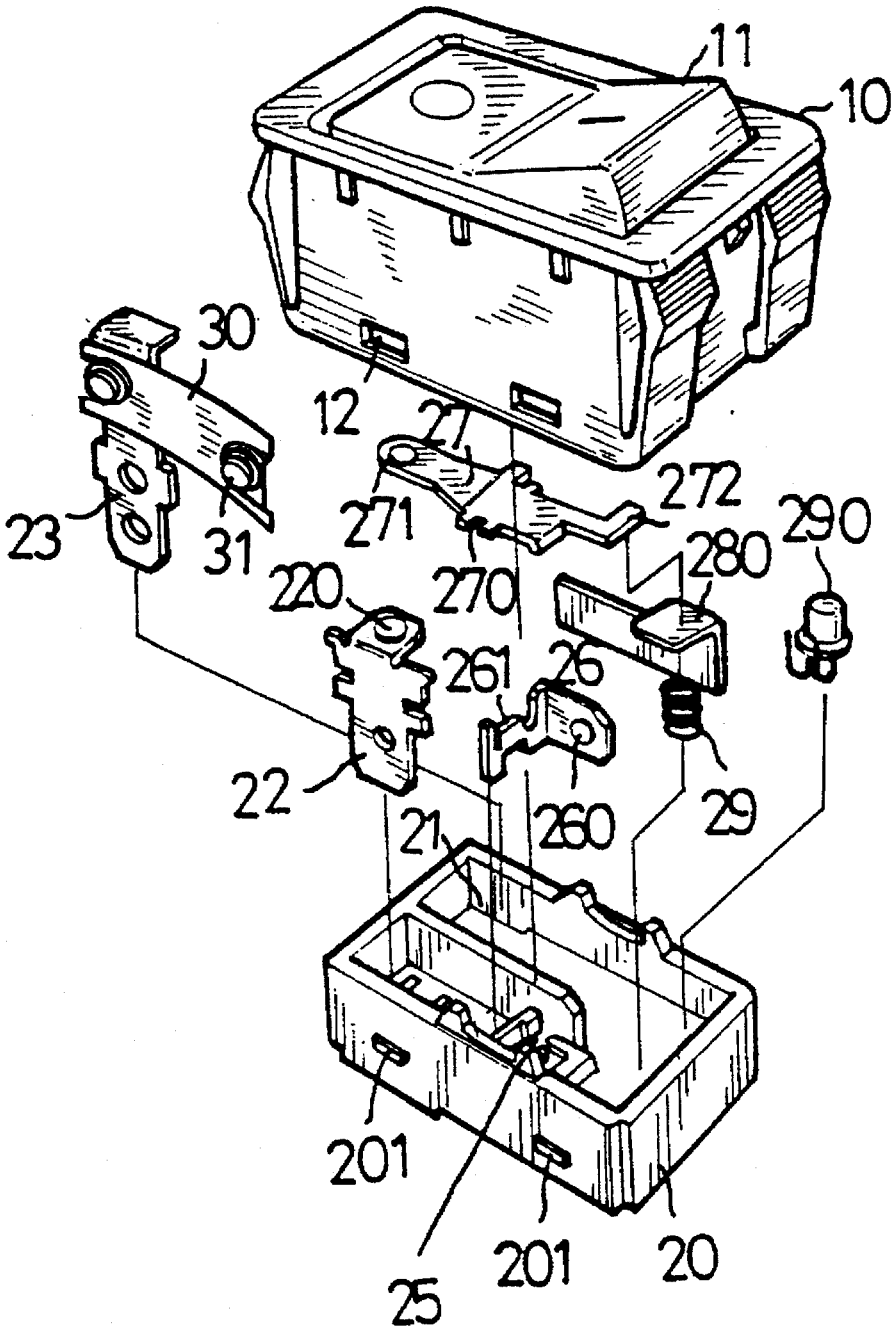
FIG. 7 is an exploded view of another embodiment of an overcurrent breaker switch in accordance with the present invention.

Referring now to FIG. 7 in which a second embodiment of the switch is shown. The difference between this embodiment and the above embodiment is that the blades 22 and 23 in this embodiment are disposed on two adjacent corners of the bottom wall of the lower housing 20 and the dual metal plate 30 with a contact 31 thereon has a configuration different from that of plate 24. Structures and operation of blades 22 and 23, lever plate 27, lever plate base 26, and insulating plate 28 are identical to those in the above embodiment and therefore are not redundantly described herein.

Although the invention has been explained in relation to its preferred embodiment, it is to be understood that many other possible modifications and variations can be made without departing from the spirit and scope of the invention as hereinafter claimed.

I claim:

1. An overcurrent breaker switch comprising:

an upper housing including a lever block with a push rod;

a lower housing engaged with said upper housing;

first and second blades mounted to said lower housing, said second blade having a dual metal plate mounted thereon;

a lever plate base being mounted in said lower housing and having a first end for releasable electrical connection with said dual metal plate and a second end;

a conductive lever plate pivotally mounted to said second end of said lever plate base and actuatable by said push rod under operation of said lever block, said conductive lever plate having a first end for releasable electrical connection with said first-blade and a second end, a pressing piece being formed on said second end of said conductive lever plate; and an insulating plate mounted between said lever plate base and said dual metal plate and having an insulating piece below said pressing piece of said conductive plate, and a spring being mounted under said insulating piece to provide an upward force;

whereby when said switch is under an overload condition, said dual metal plate disengages with said lever plate base and said insulating plate is moved upwardly under action of said spring thereby breaking the circuit.

2. The switch as claimed in claim 1 wherein said second end of said lever plate base includes a recess and said conductive lever plate includes a pair of engaging pieces on a mediate section thereof for pivotally engaging with said recess.

3. The switch as claimed in claim 1 wherein said first and second blades are mounted to two adjacent corners of a bottom wall of said lower housing.

4. The switch as claimed in claim 1 wherein said first and second blades are mounted to two diagonal corners of a bottom wall of said lower housing.

5. The switch as claimed in claim 1 wherein said dual metal plate is a plate cut in a mediate section thereof to form a flexible plate, said flexible plate having a contact on a distal end thereof for engaging with said lever plate base.

6. The switch as claimed in claim 1 wherein said dual metal plate is a flexible plate which is perpendicularly attached to said second blade, said flexible plate having a contact on a distal end thereof for engaging with said lever plate base.

* * * * *